US009066630B1

(12) United States Patent
Burgio, Jr.

(10) Patent No.: US 9,066,630 B1
(45) Date of Patent: Jun. 30, 2015

(54) BATHTUB SURROUND, KIT AND METHOD

(75) Inventor: James G. Burgio, Jr., Greensboro, NC (US)

(73) Assignee: Advanced Technology, Inc., Greensboro, NC (US)

( * ) Notice: Subject to any disclaimer, the term of this patent is extended or adjusted under 35 U.S.C. 154(b) by 535 days.

(21) Appl. No.: 13/523,364

(22) Filed: Jun. 14, 2012

(51) Int. Cl.
*A47K 3/00* (2006.01)

(52) U.S. Cl.
CPC ..... *A47K 3/00* (2013.01)

(58) Field of Classification Search
CPC ..... A47K 3/284
USPC ..... 4/596–614; 229/124; 217/76
See application file for complete search history.

(56) References Cited

U.S. PATENT DOCUMENTS

| | | | | |
|---|---|---|---|---|
| 3,588,925 | A * | 6/1971 | Kuypers | 4/595 |
| 3,653,579 | A * | 4/1972 | Stranicky | 229/124 |
| 3,865,300 | A * | 2/1975 | Caveney et al. | 229/125.07 |
| 3,977,136 | A * | 8/1976 | Daniels | 52/35 |
| 3,992,825 | A * | 11/1976 | May | 52/35 |
| 4,020,602 | A * | 5/1977 | Daniels | 52/35 |
| 4,080,710 | A * | 3/1978 | Hess | 29/416 |
| 4,289,818 | A * | 9/1981 | Casamayor | 428/43 |
| 4,398,639 | A * | 8/1983 | Daniels | 211/105.1 |
| 4,825,480 | A * | 5/1989 | Moore | 4/595 |
| 4,993,201 | A * | 2/1991 | Bunyard | 52/35 |
| 5,829,071 | A * | 11/1998 | Lavalle | 4/580 |
| 6,691,339 | B1 * | 2/2004 | Thomas | 4/610 |
| 7,028,349 | B2 * | 4/2006 | Helmetsie et al. | 4/596 |

* cited by examiner

*Primary Examiner* — Lori Baker
(74) *Attorney, Agent, or Firm* — Blake P. Hurt

(57) ABSTRACT

A decorative surround for a tub, shower or the like is formed with three decorative polymeric panel members. A kit and method of installation for a home owner or others with little installation experience can enhance a bathroom and can be assembled and installed in an easy, quick and secure manner.

18 Claims, 7 Drawing Sheets

BATHTUB SURROUND, KIT AND METHOD

FIELD OF THE INVENTION

The invention herein pertains to decorative wall surrounds and particularly pertains to wall panel kits for installation around tubs and showers.

DESCRIPTION OF THE PRIOR ART AND OBJECTIVES OF THE INVENTION

In recent years remodeling of bathrooms has become increasingly important as builders and sellers understand the importance and value of high end decorative bathrooms. While ceramic tile is often used in expensive homes and other building bathroom surrounds, a very large market exists in moderate to lower priced homes during construction or remodeling. As a result of the needs and requirements for durable, attractive, long lasting upgrades, the current invention was developed and one of its objectives is to provide an inexpensive surround for bathroom tubs and showers which can be easily installed by relatively unskilled personnel.

It is another objective of the present invention to provide in kit form, a series of surround member panels which can be applied to existing walls and quickly, securely adhered thereto.

It is still another objective of the present invention to provide preformed surround panel members which are formed in sections that can be folded at the corners for applying in overlapping fashion, with a back panel.

It is yet another objective of the present invention to provide a method for installing a bathroom tub or shower surround which can be quickly applied to existing walls by inexperienced personnel that is durable, decorative and watertight.

It is a further objective of the present invention to provide a tub surround composed in one embodiment of a series of thin decorative polymeric panels having raised faces that can be cut and trimmed to fit with conventional scissors.

It is still a further objective of the present invention to provide a wall surround which is relatively inexpensive to make, ship and purchase.

Various other objectives and advantages of the present invention will become apparent to those skilled in the art as a more detailed description is set forth below.

SUMMARY OF THE INVENTION

The aforesaid and other objectives are realized by providing a kit having relatively large first and second surround member panels with indentations for folding and joining to a relatively large back panel. The indentations or grooves allow the surround member panels to be pivoted or bent at ninety degree)(90° angles for placement along opposing end walls and corners around for example, a bath tub. The back panel can then be placed against a sidewall over flat sections of the bent surround member panels which have been adhered to the end walls for example with a standard silicone adhesive. Once installed caulking techniques are then used to seal the tops and bottoms of the surround member panels and back panel which include small pivotable tabs to insure and prevent water leakage behind the surround member panels and back panel. Matching trim may be optionally available to provide a finished look to the installation. Pivotable tabs on the surround member panels and back panel prevent water leakage along the tub or other lower abutting surfaces. Raised faces of various designs and decorations are available in various colors and styles. The flat section on the surround member panel extensions provide secure, watertight attachment in receiving the back panel thereagainst during installation.

DETAILED DESCRIPTION OF THE PREFERRED EMBODIMENT AND OPERATION OF THE INVENTION

Figure 1:
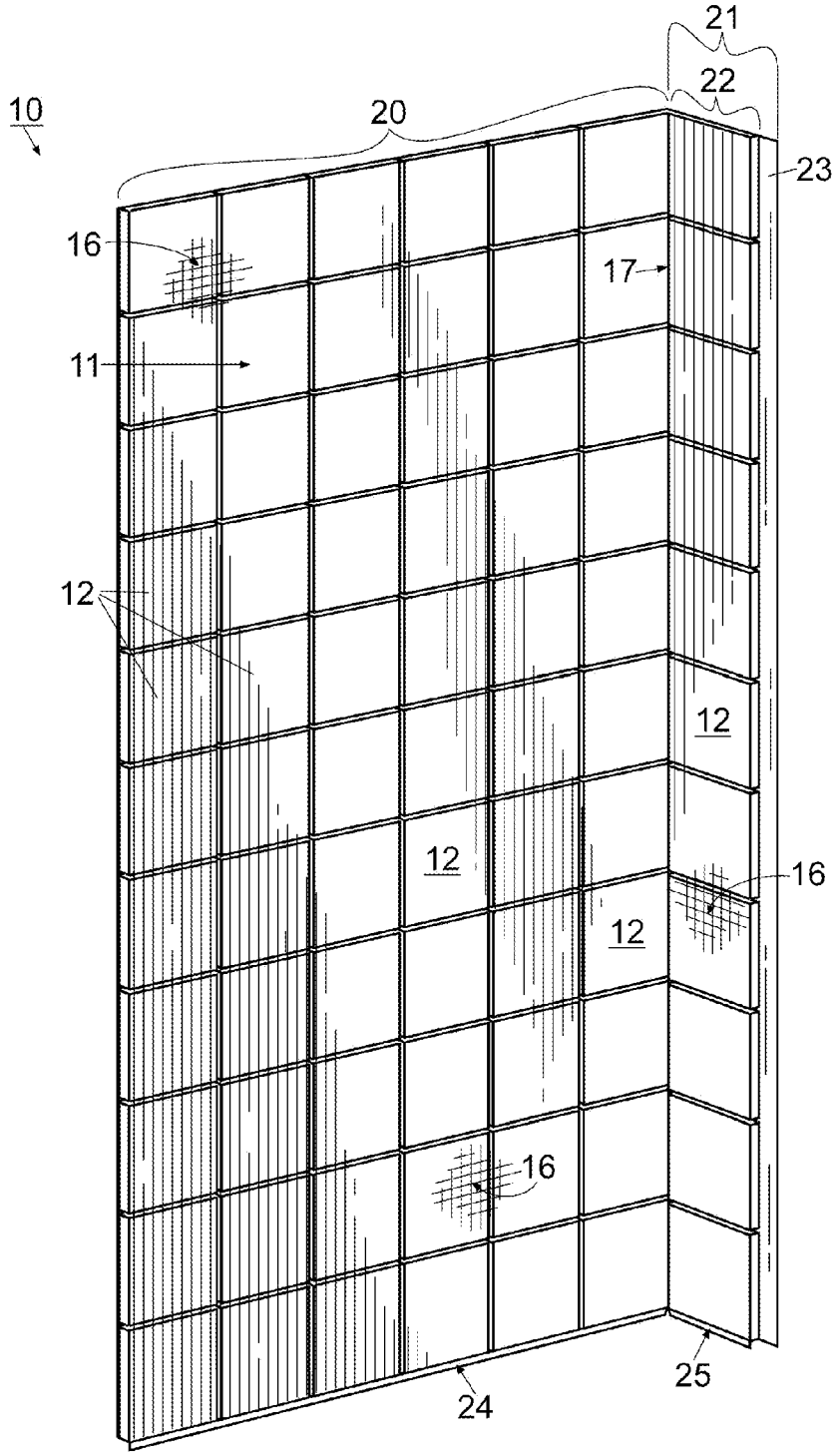
FIG. 1 shows a front perspective view of an uninstalled surround member panel of the invention with the extension turned at a ninety degree)(90° angle to the large section.
Figure 2:
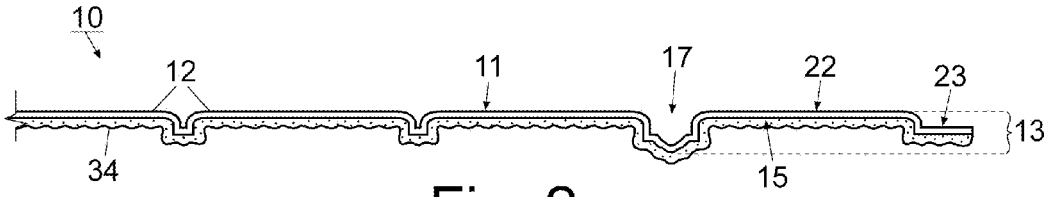
FIG. 2 pictures an enlarged top partial view of one end of the surround member panel with an adhesive as seen in FIG. 1 before the extension is pivoted.
Figure 3:
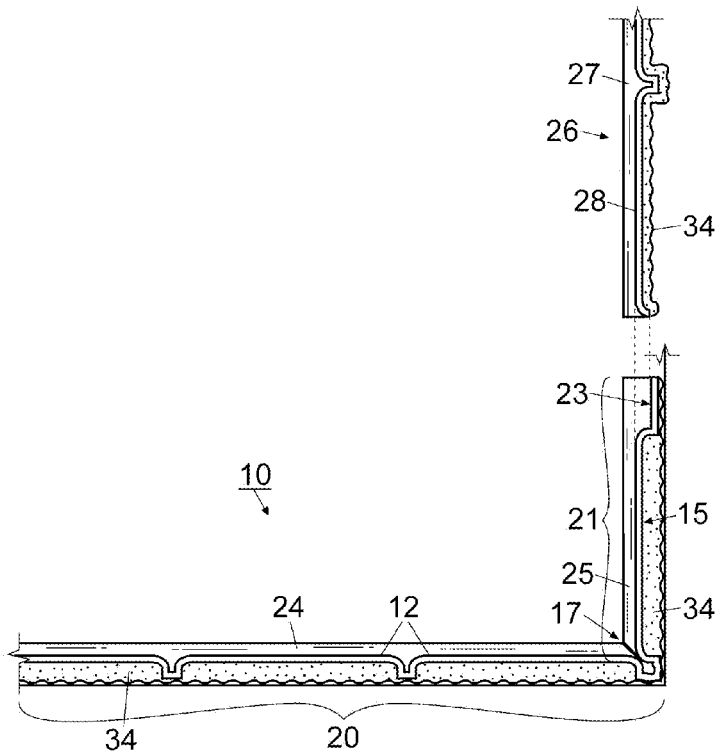
FIG. 3 depicts another enlarged top partial view of the surround member panel seen in FIG. 2 with the extension pivoted to receive the partial back panel also having an adhesive applied.
Figure 4:
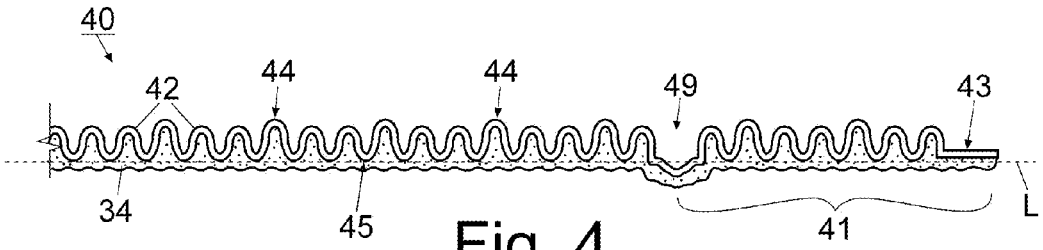
FIG. 4 demonstrates another surround member panel having a wave shape seen in an enlarged top partial view before the extension is pivoted and with an adhesive applied.
Figure 5:
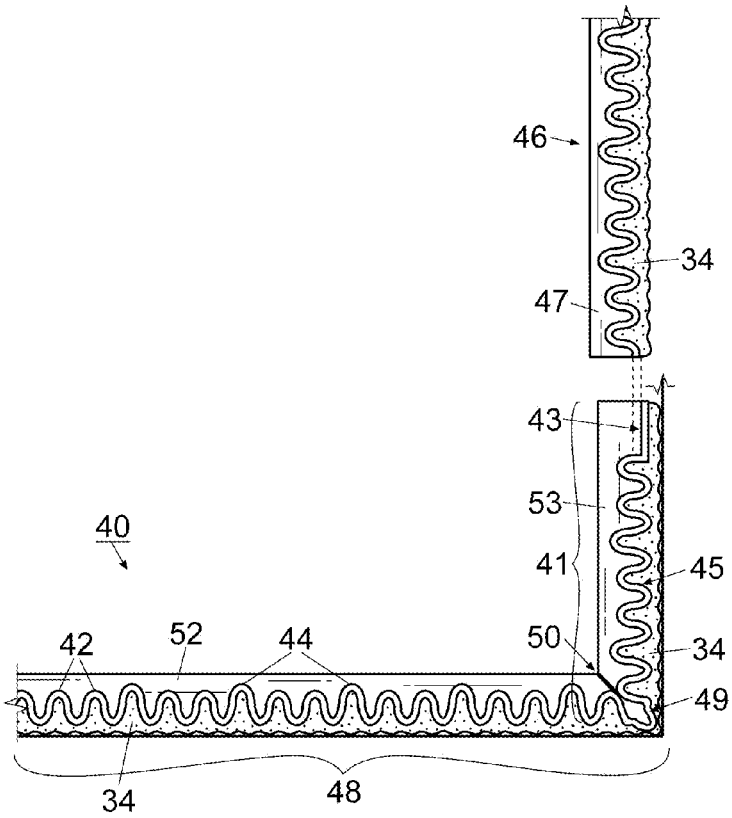
FIG. 5 shows a top partial view of the wave shaped surround member panel seen in FIG. 4 with the extension pivoted prior to assembly with a wave shaped back panel, also seen in partial view, both with adhesive applied.
Figure 6:
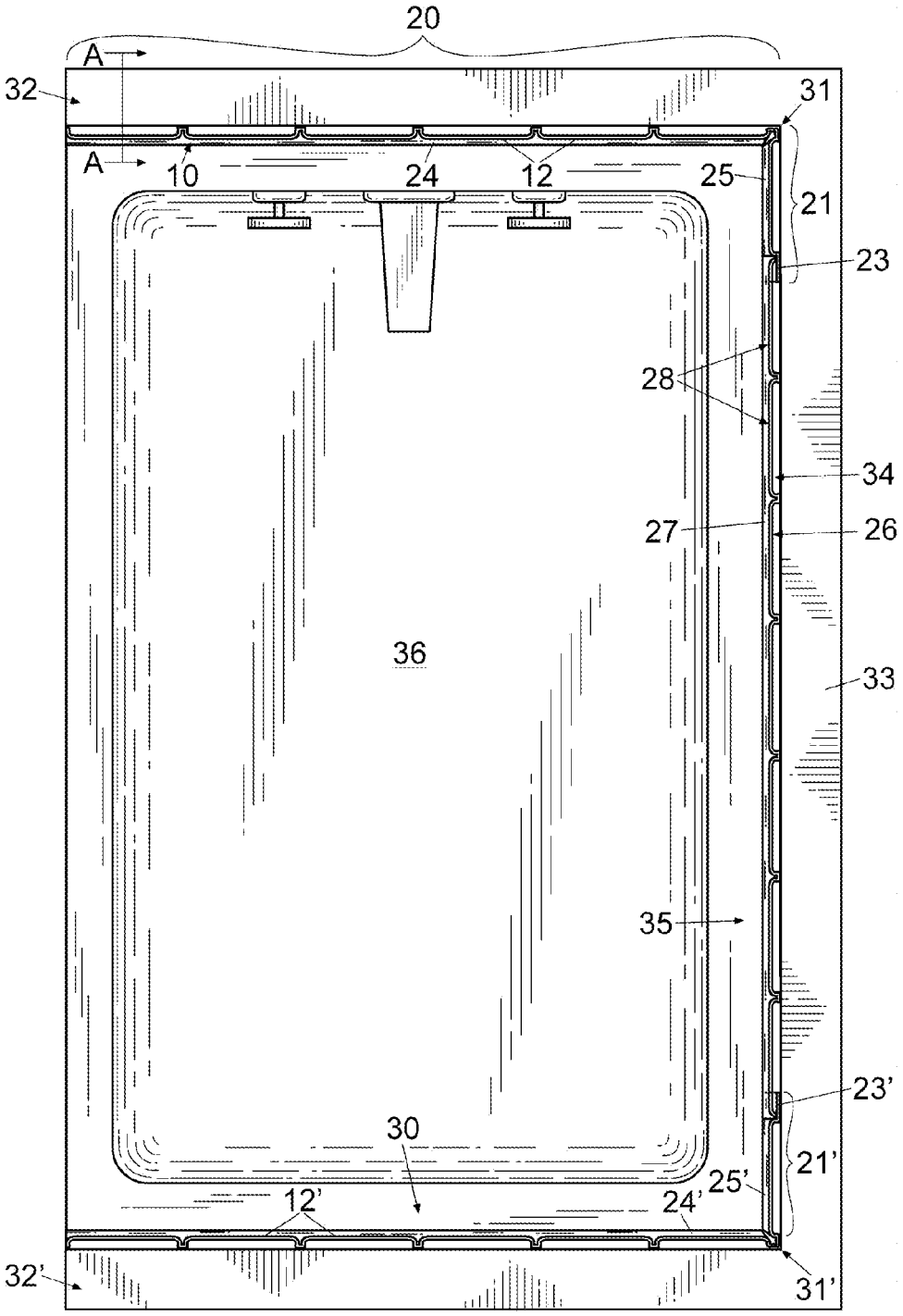
FIG. 6 demonstrates a top plan view of a typical bathtub with the surround member panels and back panel installed.

For a better understanding of the invention and its method of use, turning now to the drawings, FIGS. 1, 2 and 3 show preferred surround member panel 10 which consists of an approximate four foot by eight foot sheet of polymeric material formed preferably from thin gauge polyvinyl chloride (PVC) colored and decorated. Raised face 11 is formed as a tile format with raised portions 12. FIG. 6 demonstrates bathtub surround 35 installed around tub 36. Surround 35 includes opposing identical surround member panels 10 and 30 and preferred back panel 26 which join together as described in more detail below to provide aesthetically pleasing, durable, waterproof tub surround 35. Raised face 11 may consist of various shapes and types of designs which may be regular raised shapes or irregular shapes as seen in FIGS. 4 and 5 with wave surround member 40 having raised wave-like portions 42 with exaggerated waves 44.

Preferred surround member panel 10 and second surround member panel 30 each have a series of tile like squares which form respectively raised portions 12, 12' thereon. Surround member panel 10 preferably has dimensions of about four feet by eight feet with an overall thickness or depth 13 of approximately 0.375 inches (0.952 cm) as seen in FIG. 2 as formed from a standard PVC sheet with a thickness of 0.032 inches (0.081 cm). This thickness allows surround member panel 10 to be easily cut by a conventional knife or scissors during installation. Rear surface 15 of surround member panel 10 seen in FIGS. 2 and 3 is coated with silicone adhesive 34. As would be understood, second surround member panel 30 shown in FIG. 6 is a mirror image of first surround member panel 10 and for brevity is not described in detail herein.

Back panel 26 shown partially in FIG. 3 and fully in FIG. 6 includes raised portions 28 thereon to match surround members panels 10 and 30. Surround member panels 10, 30 and back panel 26 each include top coat 16 which is water, chemical, scratch and abrasion resistant to increase the structural integrity and for protection in a water laden environment. Top coat 16 is preferably a conventional 2 mil rigid PVC coating applied to the standard PVC sheets of surround member panels 10, 30 and back panel 26.

As further shown in FIGS. 1 and 2, surround member panel 10 includes an indentation or fold line 17. Fold line 17 allows a user to easily install and bend surround member panel 10 (FIGS. 3 and 6) and second surround member panel 30 to fit within respectively corners 31, 31' of walls 32, 32' and 33 during installation, as shown in FIGS. 2, 3 and 6 by using standard silicon adhesive 34.

As further shown in FIGS. 1 and 6, surround member panel 10 includes large rectangular section 20 and smaller rectangular extension section 21 having raised portion 22 and flat section 23 as also seen in FIG. 3. Large rectangular section 20 and smaller rectangular extension section 21 both include raised portions 12 formed in squares. While squares are seen in the preferred form, waves (FIGS. 4 and 5) or other designs could also be provided in various colors for the raised portions of surround member panels 10, 30 and back panel 26.

Smaller extension section 21 (FIGS. 1, 2, 3 and 6) is separated from large rectangular section 20 by indentation 17. As further seen in FIG. 6, large rectangular section 20 is pressed tightly into corner 31 with extension 21 folded perpendicular to large section 20 at indentation 17 as also seen in FIG. 3. If surround member panel 10 fits and no alterations, trimming or cut holes are needed, silicone adhesive 34 is applied to rear surface 15 of large rectangular section 20 and extension 21 to adhere surround member panel 10 to end wall 32 and side wall 33 (FIG. 6). Second surround member panel 30 also shown in FIG. 6 is installed in mirror fashion on opposing wall 32' prior to installation of back panel 26. Silicone adhesive 34 is applied to the front and rear surfaces of flat sections 23, 23' respectively of surround member panel 10 and second surround member panel 30 for adhering back panel 26 thereto. As would be understood, flat sections 23, 23' do not have raised portions 12 thereon and are overlain by the edges of back panel 26 as shown in FIG. 6. The rear surfaces of first surround member panel 10, second surround member panel 30 and back panel 26 are coated with adhesive 34 for adhesion to walls 32, 32' and 33 or the like to insure good water resistance.

Figure 6A:
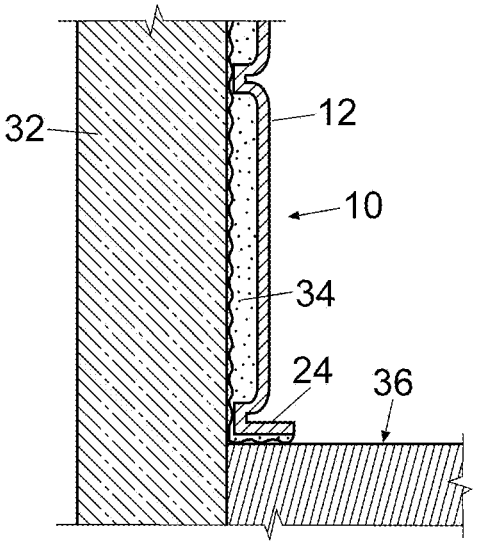
FIG. 6A illustrates an enlarged cross-sectional view of a surround member panel installed on the wall and tub as seen along lines A-A of FIG. 6.

As further seen in FIGS. 2 and 3, large rectangular section 20 of surround member 10 includes a foldable, pivotable tab 24 and extension 21 includes pivotable tab 25 whereas second surround member 30 includes pivotable tabs 24', 25'. Back panel 26 includes pivotable tab 27. Pivotable tabs 24, 24', 25, 25' and 27 are upwardly pivotable at a ninety (90°) angle (FIG. 6A) to form a bottom edge that will engage and be sealed against the top surface of a tub or the like such as tub 36 as shown in FIG. 6 to prevent water infiltration behind surround 35.

Cutouts in surround member panels 10, 30 and back panel 26 for the tub faucets, showerheads, handles, spouts and the like can be made using a simple standard circular saw, a razor knife or scissors. Likewise, each surround member panel 10, 30 and back panel 26 can be easily trimmed to an exact size and fit with a razor knife or scissors due in part to their composition and thickness.

In another embodiment of the invention, FIGS. 4 and 5 demonstrate surround member panel 40 having a sinuous view as seen in a top end view. Surround member 40 is abbreviated in FIGS. 4 and 5 and is shown by base line L, the bottom of each of the waves is flush with line L as is the bottom of flat section 43 of extension 41. This allows surround member 40 to be placed in a flat manner against a wall surface for secure mounting by using standard silicone adhesive 34. As shown, certain of the outer surfaces of surround member 40 are uneven as evidenced by exaggerated waves 44. In FIGS. 4 and 5, surround member panel 40 includes extension 41 and indentation 49 to form fold line 50 seen generally in FIG. 5 for fitting a wall corner. In FIG. 5 extension 41 is pivoted in a ninety (90°) angle to large section 48 for assembly with back panel 46.

As further seen in FIG. 5, wave surround member 40 includes a foldable, pivotable tab 52 whereas extension 41 includes pivotable tab 53. Back panel 46 includes pivotable tab 47. Pivotable tabs 52, 53 and 47 are all operated in the same manner as described with pivotable tabs 24, 25 and 27 of respectively surround member panel 10 and back panel 26 sealed against the top surface of a tub or the like to prevent water infiltration behind surround members. Back panel 46 in FIG. 5 is shown prior to assembly with extension 41 during the installation process. Also shown in FIG. 5 extension 41 is pivoted at indentation 49 into perpendicular alignment with large section 48 forming fold line 50 therealong as generally shown by arrow 50.

Figure 7:
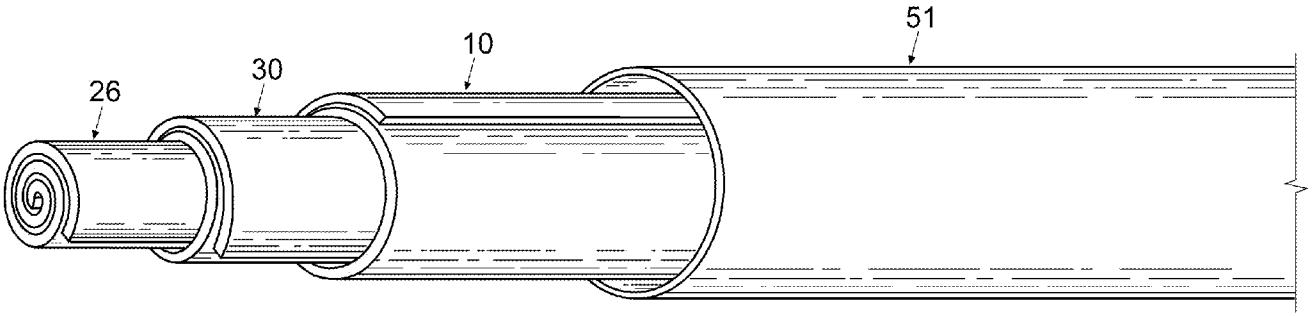
FIG. 7 pictures a tubular kit of the bathtub surround opened to expose the contents.
Figure 8:
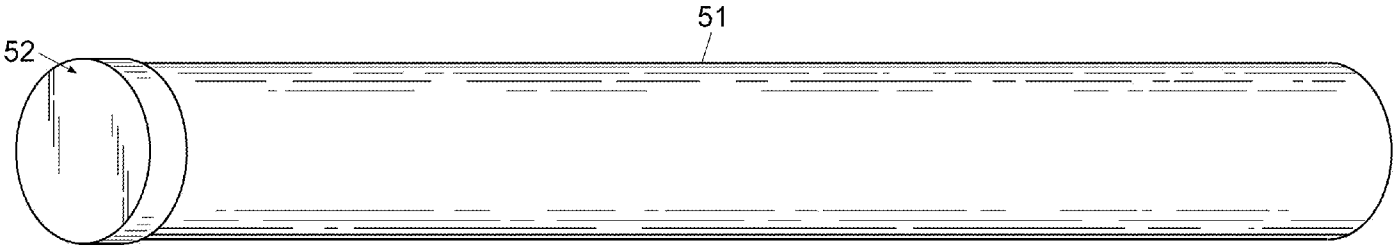
FIG. 8 features the kit of FIG. 7 closed with a cap.
Figure 9:
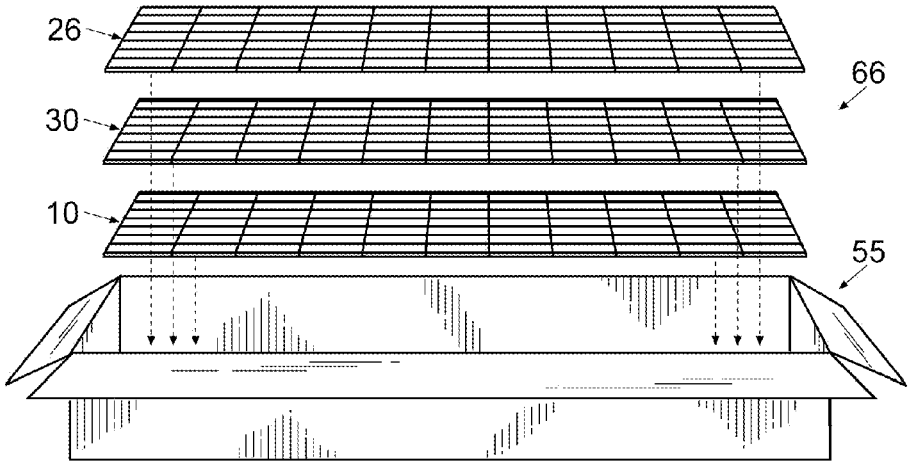
FIG. 9 shows another kit with a box container and the surround member panels and back panel exploded therefrom.

The preferred method of installing tub surround 35 as seen in FIG. 6 above a bathroom tub 36 or shower includes the steps of providing first surround member panel 10 as shown in FIG. 1, back panel 26 and second surround member panel 30 as shown in FIG. 6 from, for example kit 51 (FIGS. 7 and 8) or kit 66 (FIG. 9). Next, appropriate cutouts for the various plumbing components are manually made using scissors, a razor knife or the like (not shown) such as for a shower head, faucet or the like. Next, large section 20 of first surround member panel 10 is adhered to end wall 32 as shown in FIG. 6 for the full tub width approximately forty-six to forty-eight (46-48) inches. Extension 21 is then bent or pivoted at a ninety degree (90°) angle and is fitted into corner 31 formed by end wall 32 and side wall 33. Thereafter, second surround member panel 30 is applied to opposing end wall 32' and extension 21' is bent into wall corner 31'. Next, back panel 26 is adhered to side wall 33 along the tub length with standard silicone adhesive 34 (FIG. 3). The side edges of back panel 26 are then adhered with adhesive 34 to overlap flat sections 23, 23' of surround member panels 10, 30 respectively to insure a good watertight fit. A conventional silicone bead (not shown) is then used to seal the tops, bottoms and all joints of the intersections of back panel 26 and surround member panels 10, 30. Matching trim (not shown) can be optionally applied to provide a finished look to the installation.

The illustrations and examples provided herein are for explanatory purposes and are not intended to limit the scope of the appended claims.

I claim:

1. A surround for a tub or shower comprising: a first member with a pivotable tab attached to said first member, a first member extension, said first member pivotally attached to said first member extension, a back panel, said back panel overlapping said first member extension to form a surround.

2. The surround of claim 1 further comprising a second member, a second member extension, said second member extension pivotally joined to said second member, said back panel overlapping said second member extension.

3. The surround of claim 1 wherein said first member is eight feet in height.

4. The surround of claim 1 wherein said first member is formed from a polymeric material.

5. The surround of claim 4 wherein said polymeric material is PVC.

6. The surround of claim 1 wherein said first member defines a fold line, said fold line defined between said first member extension.

7. The surround of claim 2 wherein said first member and said second member each define a raised face.

8. The surround of claim 1 wherein said back panel defines a raised face.

9. The surround of claim 1 further comprising a pivotal extension tab, said pivotable extension tab attached to said first member extension.

10. The surround of claim 1 wherein said first member extension comprises a flat section.

11. The surround of claim 2 wherein said second member extension comprises a flat section.

12. A method of installing a surround above a bathroom tub comprising the steps of:

a) providing a first member with an extension, a pivotable tab, and a back panel;

b) attaching the first member to a first wall above the tub near a corner;

c) pivoting the first member extension at the corner;

d) attaching the back panel to a back wall adjacent the first wall; and e) adhering the back panel to the back wall and to the first member in an overlapping relation.

13. The method of claim 12 further comprising the step of attaching a second member on a second wall in opposing relation to the first member using an adhesive.

14. The method of claim 13 further comprising the step of attaching the back panel in an overlapping relation to the second member.

15. The method of claim 12 wherein pivoting the first member comprises the step of pivoting the first member for attaching the first member extension to the back wall.

16. A kit for installing a tub surround comprising:

a) a first member, said first member comprising a raised face, a pivotable tab, a pivotable extension, said pivotable extension hingedly attached to said first member;

b) a back panel, said back panel comprising a raised face;

c) a second member, said second member comprising a raised face, a pivotable extension, said raised face attached to said pivotable extension; and d) a container, said first member, said back panel and said second member positioned within said container.

17. The kit of claim 16 wherein said container defines a tubular shape.

18. The kit of claim 16 wherein said container comprises a box.

* * * * *